United States Patent [19]

Marks et al.

[11] 3,959,095

[45] May 25, 1976

[54] METHOD OF OPERATING A THREE COMPARTMENT ELECTROLYTIC CELL FOR THE PRODUCTION OF ALKALI METAL HYDROXIDES

[75] Inventors: Gerald R. Marks, Youngstown; Blaine O. Schoepfle, Snyder, both of N.Y.

[73] Assignee: Hooker Chemicals & Plastics Corporation, Niagara Falls, N.Y.

[22] Filed: Jan. 31, 1975

[21] Appl. No.: 545,858

[52] U.S. Cl. ..... 204/98; 204/128

[51] Int. Cl.[2] ..... C25B 1/16; C25B 1/26

[58] Field of Search ..... 204/98, 128

[56] References Cited

UNITED STATES PATENTS

| | | | |
|---|---|---|---|
| 2,967,807 | 1/1961 | Osborne et al. | 204/98 |
| 3,438,879 | 4/1969 | Kircher et al. | 204/98 |
| 3,773,634 | 11/1973 | Stacey et al. | 204/98 |

OTHER PUBLICATIONS

"New Product Info. from R & D Div., Plastics Dept., E. I. Dupont," XR Perfluorosulfonic Acid Membranes, Oct. 1, 1969, pp. 1–4.

*Primary Examiner*—R. L. Andrews

*Attorney, Agent, or Firm*—Peter F. Casella; Herbert W. Mylius

[57] ABSTRACT

This invention relates to an improved method of operating a three compartment electrolytic cell which comprises an anode compartment, a buffer compartment and a cathode compartment. More specifically, it concerns an improved method of operating a three compartment cell used in the electrolytic production of chlorine and caustic wherein the solution produced in the buffer compartment is either chemically or physically treated to optimize the overall operation of the three compartment electrolytic cell.

12 Claims, 1 Drawing Figure

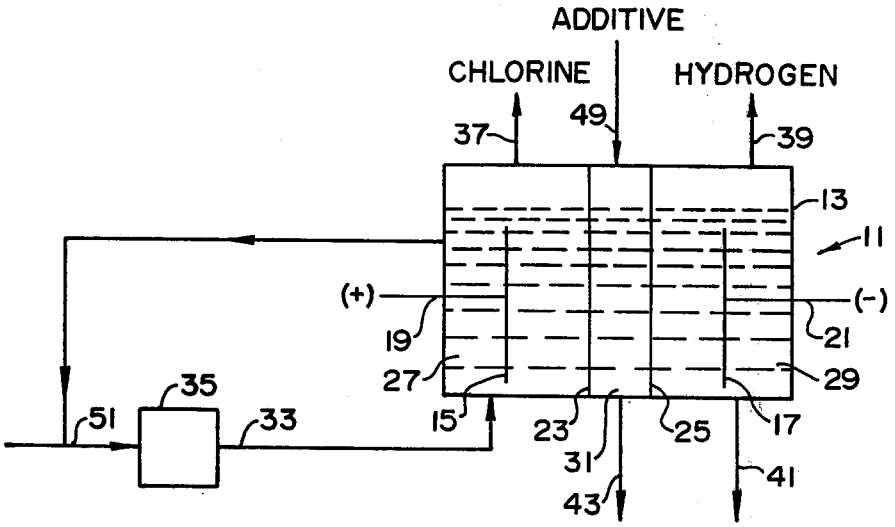
ADDITIVE
CHLORINE
HYDROGEN
37
49
39
13
11
(+)
(-)
19
21
27
29
35
51
33
15
23
25
17
31
41
43

METHOD OF OPERATING A THREE COMPARTMENT ELECTROLYTIC CELL FOR THE PRODUCTION OF ALKALI METAL HYDROXIDES

In another co-pending patent application, Ser. No. 411,618, filed Nov. 1, 1973, which is assigned to the assignee of the present application, entitled "Electrolytic Method for the Simultaneous Manufacture of Concentrated and Dilute Aqueous Hydroxide Solutions", there is described, for the production of sodium hydroxide, an electrolytic cell having at least three compartments, including an anode compartment, a buffer compartment and a cathode compartment with cation-active permselective membranes separating the buffer compartment from the other compartments. This application and the disclosure therein is incorporated herein by reference.

In the operation of such a cell to electrolyze a solution of, for example, sodium chloride to produce chlorine and caustic a dilute solution of sodium hydroxide is produced in the buffer compartment. This so-produced dilute sodium hydroxide solution often adversely affects the overall electrical operating efficiency of the concerned cell. In addition, this dilute sodium hydroxide solution generally has limited commercial value as it cannot be readily used to economically produce high purity, high concentration sodium hydroxide or other related products.

Accordingly, it is the primary object of this invention to provide a method and means of more efficiently operating a three compartment electrolytic cell of the type herein described.

In addition, another object of this invention is to provide a means of more efficiently operating a three compartment electrolytic cell by chemically modifying the content of the buffer compartment.

Further objects of the invention will be apparent to those skilled in the art from a reading of the following description and claims.

The improved method of the present invention concerns the use of an electrolyzing apparatus which has at least three compartments therein, (i.e., an anode compartment, a buffer compartment and a cathode compartment), an anode, a cathode, at least two cation-active permselective membranes, preferrably, of a polymeric material selected from the group consisting of a hydrolyzed copolymer of a perfluorinated hydrocarbon and a fluorosulfonated perfluorovinyl ether and a sulfostyrenated perfluorinated ethylene propylene polymer, defining anode and cathode side walls of a buffer compartment or compartments between anode and cathode compartments, and such walls, with walls thereabout, defining anode and cathode compartments.

In preferred embodiments of the invention the permselective membranes are of a hydrolyzed copolymer of tetrafluoroethylene and a fluorosulfonated perfluorovinyl ether of the formula $FSO_2CF_2CF_2OCF(CF_3)CF_2OCF{=}CF_2$, hereafter called PSEPVE, which polymer has an equivalent weight of about 900 to 1,600, only two such membranes are employed and the membranes are mounted on networks of supporting material such as polytetrafluoroethylene, perfluorinated ethylene propylene polymer, polypropylene, asbestos, titanium, tantalum, niobium or noble metals.

The instant invention will be more readily understood by reference to the following description of various embodiments thereof, taken in conjunction with the drawing which shows a general means for carrying out the herein described invented processes.

In the drawing, the FIGURE is a schematic diagram of a three compartment electrolytic cell which is especially adapted for the production of alkali metal hydroxide.

In the FIGURE, electrolytic cell 11 includes outer wall 13, anode 15, cathode 17 and conductive means 19 and 21 for connecting the anode and the cathode to sources of positive and negative electrical potentials, respectively. Inside the walled cell permselective membranes 23 and 25 divide the volume into anode or anolyte compartment 27, cathode or catholyte compartment 29 and buffer compartment 31. An aqueous solution of alkali metal halide, preferrably acidic, is fed to the anolyte compartment through line 33, from saturator 35 to fill the cell with solution to be electrolyzed. During electrolysis chlorine gas is removed from above the anode compartment through line 37 and hydrogen gas is correspondingly removed from above the cathode compartment through line 39. More concentrated hydroxide solution is withdrawn from cathode compartment 29 through line 41. Solution is withdrawn from the buffer compartment through line 43. This solution may simply be a low concentration hydroxide solution or that resulting from reacting the solution in the buffer compartment with various reactants. (In addition, it should be noted that, as desired, solids may also be removed from the buffer compartment via line 43 by conventional techniques). Water or other additives or reactants may be added to buffer compartment 31 of three compartment cell 11 through line 49. In addition, solid sodium chloride or other source of chloride ions may be fed to saturator 35 through line 51 to raise the chloride concentration in the feed to the cell. The anolyte may be recirculated back to the saturator for addition of salt to maintain the desired concentration thereof in the anolyte.

In the operation of a three compartment cell of the hereinbefore described type an undesirable voltage drop is often experienced. For example, in electrolyzing a solution of sodium chloride to produce chlorine, hydrogen and caustic in a three compartment cell of the hereinbefore described type, the cell concentration gradient in the buffer compartment often ranges from 80 to 150 gpl (grams per liter) NaOH. At 1.3 amperes per square inch with bulk solution concentrations of 100 gpl and 200 gpl in the buffer and cathode compartments respectively, a voltage of 4.8 was obtained.

To reduce this concentration gradient a pump was used to recirculate the buffer solution in the buffer compartment by employing a system of inlet and outlet piping directly tied to the buffer compartment. Solution in the buffer compartment 31 was removed therefrom by pumping via line 43 and returned thereto through line 49. With this type of mixing, the concentration gradient in the buffer compartment was essentially eliminated, obtaining a voltage of 4.2. That is, the concentration of the sodium hydroxide in the buffer compartment was essentially uniform while improved electrical operation of the cell was achieved.

From the foregoing, it can be readily seen that by mixing the solution in the buffer compartment improved cell operation can be achieved. While mixing by means of pumping specifically has been described herein, it will be readily apparent to those skilled in the art that other forms of mixing may be utilized in the practice of the invention. For example, such mixing may be effected by air sparging or other known mixing means which will not adversely affect cell operation or the solution in the buffer compartment.

In the operation of a three compartment cell of the type herein described, rather than operate with a dilute alkali hydroxide solution in the buffer compartment it is often desirable to neutralize the hydroxide ion with either an inorganic or organic acid. This results in the production of a solution of high product concentration in the buffer compartment and reduces caustic back migration to the anolyte compartment. This technique makes it possible to more efficiently operate the concerned three compartment cell (due to minimized caustic back migration) while producing various products of increased economic value. For example, it is known that alkaline hydroxides of sodium, potassium, lithium, rubidium and cesium can be reacted with various inorganic or organic acids to produce carbonates, sulfates, nitrates, sulfites, phosphates, acetates, benzoates, chlorides, etc., as desired.

In addition, it should be noted that in a specialized situation where large quantities of excess hydrochloric acid are available, the dilute caustic formed in the buffer compartment can be neutralized with HCl to form NaCl. The neutral or slightly acidic brine can then be recirculated to the anolyte for re-use.

Also, in the operation of a three compartment cell of the herein described type the gradient and/or concentration of hydroxide in the buffer compartment can be regulated by adding thereto cell liquor from a conventional diaphragm cell. This addition of cell liquor serves to mix the solution in the buffer compartment thereby reducing or essentially eliminating any hydroxide gradient therein. In addition, when cell liquor from a conventional diaphragm cell is added to the buffer compartment the concentration of hydroxide in the buffer compartment is increased. This solution is then removed from the buffer compartment and concentrated to the degree desired by conventional techniques. Accordingly, the high concentration hydroxide solution produced in the cathode compartment is not diluted by solution from the buffer compartment and can be either used directly or up-graded slightly to the degree desired by the use of uncomplicated apparatus and techniques which are known to those skilled in the art and accordingly will not be discussed in detail herein.

Although the preferred embodiments of the invention utilize a pair of the described membranes to form the three compartments of the present three-compartment cell it will be evident that a greater number of compartments, e.g., 4 to 6, including plural buffer zones, may be employed. Similarly, also, while the cell compartments of the concerned cell will usually be separated by flat membranes and will usually be of substantially rectilinear or parallelepidedal construction, various other shapes including curves, e.g., ellipsoids, and irregular surfaces, e.g., sawtoothed or plurally pointed walls, may also be utilized. In another variation of the invention the buffer zone formed by the plurality of membranes, will be between bipolar electrodes, rather than the monopolar electrodes which are described herein. Those of skill in the art will know the variations in structure that will be made to accommodate bipolar, rather than monopolar electrodes, and therefore, these will not be described in detail. Of course, as is known in the art, pluralities of the individual cells will be employed in multicell units, often having common feed and product manifolds and being housed in unitary structures. Again, such constructions are known to those in the art and need not be discussed herein.

The aqueous solution which is electrolyzed in the three compartment cell normally is a water solution of sodium chloride, although potassium and other soluble chlorides, e.g., magnesium chloride, sometimes also may be utilized, at least in part. However, it is preferable to employ the alkali metal chlorides and of these sodium chloride is the best. Sodium and potassium chlorides include cations which do not form insoluble salts or precipitates and which produce stable hydroxide. The concentration of sodium chloride in a brine charged will usually be as high as feasible, normally being from 200 to 320 grams per liter for sodium chloride and from 200 to 360 g./l. for potassium chloride, with intermediate figures for mixtures of sodium and potassium chlorides. The electrolyte may be neutral or acidified to a pH in the range of about 1 to 6, acidification normally being effected with a suitable acid such as hydrochloric acid. Charging of the brine is to the anolyte compartment, usually at a concentration of 200 to 320 g./l., most preferrably of 250 to 300 g./l.

The presently preferred cation permselective membrane is of a hydrolyzed copolymer of perfluorinated hydrocarbon and a fluorosulfonated perfluorovinyl ether. The perfluorinated hydrocarbon is preferrably tetrafluoroethylene, although other perfluorinated and saturated and unsaturated hydrocarbons of 2 to 5 carbon atoms may also be utilized, of which the monoolefinic hydrocarbons are preferred, especially those of 2 to 4 carbon atoms and most especially those of 2 to 3 carbon atoms, e.g., tetrafluoroethylene, hexafluoropropylene. The sulfonated perfluorovinyl ether which is most useful is that of the formula $FSO_2CF_2CF_2OCF(CF_3)CF_2OCF{=}CF_2$. Such a material, named as perfluoro[2-(2-fluorosulfonylethoxy)-propyl vinyl ether], referred to henceforth as PSEPVE, may be modified to equivalent monomers, as by modifying the internal perfluorosulfonylethoxy component to the corresponding propoxy component and by altering the propyl to ethyl or butyl, plus rearranging positions of substitution of the sulfonyl thereon and utilizing isomers of the perfluoro-lower alkyl groups, respectively. However, it is most preferred to employ PSEPVE.

The electrodes of the cell can be made of any electrically conductive material which will resist the attack of the various cell contents. In general, the cathodes are made of graphite, iron, lead dioxide on graphite or titanium, steel or noble metal, such as platinum, iridium, ruthenium or rhodium. Of course, when using the noble metals, they may be deposited as surfaces on conductive substrates, e.g., copper, silver, aluminum, steel, iron. The anodes are also of materials or have surfaces of materials such as noble metals, noble metal alloys, noble metal oxides, noble metal oxides mixed with valve metal oxides, e.g., ruthenium oxide plus titanium dioxide, or mixtures thereof, on a substrate which is conductive. Preferrably, such surfaces are on or with a valve metal and connect to a conductive metal, such as those described. Especially useful are platinum, platinum or titanium, platinum oxide on titanium, mixtures of ruthenium and platinum and their oxides on titanium and similar surfaces on other valve metals, e.g., tantalum. The conductors for such materials may be aluminum, copper, silver, steel or iron, with copper being much preferred. A preferrable dimensionally stable anode is ruthenium oxide-titanium dioxide mixture on a titanium substrate, connected to a copper conductor.

The voltage drop from anodes to cathodes are usually in the range of about 2.3 to 5 volts, although sometimes they are slightly more than 5 volts, e.g., up to 6 volts. Preferrably, they are in the range of 3.5 to 4.5 volts. The current densities, while they may be from 0.5 to 4 amperes per square inch of electrode surface, are preferrably from 1 to 3 amperes/sq. in. and ideally about 2 amperes/sq. in. The voltage ranges are for perfectly aligned electrodes and it is understood that where such alignment is not exact, as in laboratory units, the voltages can be up to about 0.5 volt higher.

As used herein the term "cation-active permselective membranes" means membranes which resist the passage therethrough of cations.

The invention has been described with respect to working examples and illustrative embodiments but is not to be limited to these because it is evident that one of ordinary skill in the art will be able to utilize substitutes and equivalents without departing from the spirit of the invention or the scope of the claims.

What is claimed is:

1. In the method of manufacturing an alkali metal hydroxide by the electrolysis of an aqueous salt solution containing halide ions in an electrolytic cell having at least three compartments therein, an anode positioned in the anode compartment, a cathode positioned in the cathode compartment, at least two cation-active permselective membranes of a polymeric material defining anode and cathode side walls of a buffer compartment between anode and cathode compartments, and such walls, with walls thereabout, defining anode and cathode compartments wherein the improvement comprises:

mixing the solution in the buffer compartment while electrolyzing the salt solution in said electrolytic cell so as to produce an alkali metal hydroxide solution in said buffer compartment of essentially uniform concentration.

2. The method of claim 1 wherein said mixing is accomplished by recirculating the solution in said buffer compartment.

3. The method of claim 2 wherein said recirculating is accomplished by removing a portion of the solution in said buffer compartment and then returning it thereto.

4. The method of claim 1 wherein said polymeric material is selected from the group consisting of hydrolyzed copolymer of a perfluorinated hydrocarbon and a fluorosulfonated perfluorovinyl ether and a sulfostyrenated perfluorinated ethylene propylene polymer.

5. The method of claim 1 wherein said alkali metal hydroxide is sodium hydroxide.

6. The method of claim 1 wherein said mixing is accomplished by adding cell liquor from a conventional diaphragm cell to the solution in said buffer compartment.

7. In the method of manufacturing an alkali metal hydroxide by the electrolysis of an aqueous salt solution contaning halide ions in an electrolytic cell having at least three compartments therein, an anode positioned in the anode compartment, a cathode positioned in the cathode compartment, at least two cation-active permselective membranes of a polymeric material defining anode and cathode side walls of a buffer compartment between anode and cathode compartments, and such walls, with walls thereabout, defining anode and cathode compartments wherein the improvement comprises:

reacting the alkali hydroxide solution formed in the buffer compartment with an acid selected from the group consisting of inorganic acids, organic acids and mixtures thereof.

8. The method of claim 7 wherein said polymeric material is selected from the group consisting of a hydrolyzed copolymer of a perfluorinated hydrocarbon and a fluorosulfonated perfluorovinyl ether and a sulfostyrenated perfluorinated ethylene propylene polymer.

9. The method of claim 7 wherein sufficient acid is added to said buffer compartment to essentially neutralize the alkali hydroxide therein.

10. The method of claim 7 wherein said acid is selected from the group of acids which react with alkali metal hydroxide to produce at least one compound selected from the group of alkali metal carbonates, alkali metal sulfates, alkali metal nitrates, alkali metal sulfites, alkali metal phosphates, alkali metal acetates, alkali metal benzoates, alkali metal chlorides.

11. The method of claim 7 wherein said alkali metal hydroxide is sodium hydroxide.

12. The method of claim 7 wherein said acid is hydrochloric acid.

* * * * *